US009719027B2

(12) United States Patent
Sandu et al.

(10) Patent No.: US 9,719,027 B2
(45) Date of Patent: Aug. 1, 2017

(54) LOW VISCOSITY METAL-BASED HYDROGEN SULFIDE SCAVENGERS

(71) Applicant: BAKER HUGHES INCORPORATED, Houston, TX (US)

(72) Inventors: Corina L. Sandu, Pearland, TX (US); Yun Bao, Sugar Land, TX (US); Jerry J. Weers, Richmond, TX (US); Ross Poland, Houston, TX (US); Philip L. Leung, Houston, TX (US); Lei Zhang, Houston, TX (US); John A. Schield, Missouri City, TX (US)

(73) Assignee: Baker Hughes Incorporated, Houston, TX (US)

( * ) Notice: Subject to any disclaimer, the term of this patent is extended or adjusted under 35 U.S.C. 154(b) by 505 days.

(21) Appl. No.: 14/183,109

(22) Filed: Feb. 18, 2014

(65) Prior Publication Data

US 2014/0231311 A1 Aug. 21, 2014

Related U.S. Application Data

(60) Provisional application No. 61/766,512, filed on Feb. 19, 2013.

(51) Int. Cl.

| | |
|---|---|
| ***C10G 21/16*** | (2006.01) |
| ***C10G 29/06*** | (2006.01) |
| ***C10G 29/22*** | (2006.01) |

(52) U.S. Cl.

CPC ..... *C10G 21/16* (2013.01); *C10G 29/06* (2013.01); *C10G 29/22* (2013.01); *C10G 2300/207* (2013.01)

(58) Field of Classification Search

None

See application file for complete search history.

(56) References Cited

U.S. PATENT DOCUMENTS

| | | | | |
|---|---|---|---|---|
| 3,528,935 | A * | 9/1970 | Rusnack | C09D 135/06 523/434 |
| 3,639,109 | A * | 2/1972 | Badin | C10L 1/14 44/349 |
| 3,941,606 | A | 3/1976 | Collins et al. | |
| 4,100,144 | A * | 7/1978 | Dunwald | C08G 18/8064 525/440.02 |
| 4,952,328 | A * | 8/1990 | Davis | C10M 141/10 508/233 |
| 4,981,602 | A * | 1/1991 | Ripple | C10M 141/10 508/237 |
| 5,575,951 | A * | 11/1996 | Anderson | C08K 3/16 252/400.1 |
| 6,599,472 | B1 | 7/2003 | Hudson | |
| 2002/0058745 | A1 | 5/2002 | Huang et al. | |
| 2002/0193257 | A1 | 12/2002 | Lee et al. | |
| 2004/0077753 | A1* | 4/2004 | Duvall | C08K 3/16 524/110 |
| 2006/0229197 | A1* | 10/2006 | Stark | B01J 23/002 502/304 |
| 2014/0231311 | A1 | 8/2014 | Sandu et al. | |

FOREIGN PATENT DOCUMENTS

| | | | |
|---|---|---|---|
| EP | 2958973 | A1 | 12/2015 |
| WO | 2005047178 | A2 | 5/2005 |
| WO | 2011081860 | A2 | 7/2011 |
| WO | 2011100301 | A2 | 8/2011 |
| WO | 201217771 | A2 | 6/2012 |
| WO | 2013181056 | A1 | 12/2013 |

OTHER PUBLICATIONS

Examination and Search Report in Canadian Appln 2,900,548 dated Apr. 22, 2016.

L. Ghasemi-Mobarakeh, et al., "A Novel Method for Porosity Measurement of Various Surface Layers of Nanofibers Mat Using Image Analysis for Tissue Engineering Applications," Journal of Applied Polymer Science, vol. 106, Issue 4, 2007, pp. 2536-2541.

Int'l Search Report in PCT/US2014/017037, dtd May 22, 2014.

Int'l Preliminary Report on Patentability in PCT/US2014/017037, dtd Aug. 25, 2015.

* cited by examiner

*Primary Examiner* — Joseph D Anthony

(74) *Attorney, Agent, or Firm* — Mossman, Kumar & Tyler, P.C.

(57) ABSTRACT

A composition useful for scavenging hydrogen sulfide by admixing metal carboxylates which have high viscosity due to polymerization and a viscosity improver selected from the group consisting of glycol ethers having from about 4 to about 10 carbons and alkyl alcohols having from about 1 to about 4 carbons.

4 Claims, No Drawings

LOW VISCOSITY METAL-BASED HYDROGEN SULFIDE SCAVENGERS

CROSS-REFERENCE TO RELATED APPLICATIONS

This application claims priority from U.S. Provisional Patent Application Ser. No. 61/766,512, filed on Feb. 19, 2013, the entire disclosure of which is incorporated herein by reference in its entirety.

BACKGROUND OF THE INVENTION

1. Field of the Invention

The present invention relates to additives for scavenging hydrogen sulfide. The present invention particularly relates to additives for scavenging hydrogen sulfide based upon metals such as zinc.

2. Background of the Art

The presence of sulfur species in hydrocarbon fluids and aqueous streams is undesirable for various reasons. The subterranean reservoirs currently being developed have increased amounts of sulfur species within the produced hydrocarbon streams (oil and gas). Hydrogen sulfide and mercaptans are toxic gases that are heavier than air and are very corrosive to well and surface equipment.

During combustion, sulfur-rich hydrocarbon streams also produce heavy environmental pollution. When sulfur-rich streams contact metals, sulfur species lead to brittleness in carbon steels and to stress corrosion cracking in more highly alloyed materials. Moreover, hydrogen sulfide in various hydrocarbon or aqueous streams poses a safety hazard and a corrosion hazard.

Zinc octoate is an effective hydrogen sulfide scavenger. When this compound is prepared at a ratio of zinc to octanoic acid of 1:2, it has a very high viscosity. It would be desirable in the art to prepare the zinc octoate hydrogen sulfide scavengers having comparatively low viscosity.

SUMMARY OF THE INVENTION

In one aspect, the invention is a composition useful for scavenging hydrogen sulfide comprising zinc octoate (1:2) and a viscosity improver selected from the group consisting of glycol ethers having from about 4 to about 15 carbons, and/or alkyl alcohols having from about 1 to about 10 carbons, without or with additional hydrocarbons from about 7 to about 30 carbons.

In another aspect, the invention a method for treating fluids contaminated with hydrogen sulfide comprising introducing into the hydrogen sulfide contaminated fluid an additive useful for scavenging hydrogen sulfide comprising zinc octoate (1:2) and a viscosity improver selected from the group consisting of glycol ethers having from about 4 to about 15 carbons, and/or alkyl alcohols having from about 1 to about 10 carbons, without or with additional hydrocarbons from about 7 to about 30 carbons.

In yet another, the invention is a composition useful for scavenging hydrogen sulfide comprising metal carboxylates which have high viscosity due to polymerization and a viscosity improver selected from the group consisting of glycol ethers having from about 4 to about 15 carbons, and/or alkyl alcohols having from about 1 to about 10 carbons, without or with additional hydrocarbons from about 7 to about 30 carbons.

DESCRIPTION OF THE PREFERRED EMBODIMENTS

In one embodiment, the invention is a composition useful for scavenging hydrogen sulfide comprising zinc octoate (with a 1:2 molar ratio of zinc to octanoic acid) and a viscosity improver selected from the group consisting of glycol ethers having from about 4 to about 15 (20 or more) carbons, and/or alkyl alcohols having from about 1 to about 10 carbons, without or with additional hydrocarbons from about 7 to about 30 carbons. Zinc octoate, when prepared using the ratio of 1:2 for zinc and octanoic acid, is neutral and has a very high viscosity due to intrinsic polymerization reactions. At ambient temperatures it has a viscosity similar to that of extremely thick syrup. It is very difficult to handle such fluids. Note, the term "zinc octoate" for the purposes of this application is used to describe zinc organic based complexes salts, the reaction product of zinc resources (such as zinc powder and zinc oxide) and for example 2-ethyl hexanoic acid. This is the common industry usage and is employed herein to avoid confusion to those of ordinary skill in the art.

It has been discovered that small amounts of certain glycol ethers and/or alkyl alcohols can produce dramatic changes in the viscosity of the zinc octoate. The glycol ethers useful with the method of the disclosure include those having from about 5 to about 15 carbons. Exemplary compounds include but are not limited to: ethylene glycol monomethyl ether; ethylene glycol monoethyl ether; ethylene glycol monopropyl ether; ethylene glycol monoisopropyl ether; ethylene glycol monobutyl ether; diethylene glycol monomethyl ether; diethylene glycol monoethyl ether; diethylene glycol mono-n-butyl ether; and combinations thereof.

The low molecular weight alkyl alcohols useful with the method of the disclosure include those having from about 1 to about 15 carbons. Exemplary alcohols include, but are not limited to: methanol; ethanol; propanol; isopropanol; and combinations thereof.

In addition to zinc, the method of the disclosure may also be employed with other metal octoates. Other metals that may be employed include, but are not limited to iron, manganese, cobalt, nickel, and the like. The use of mixed metal octoates is also within the scope of the disclosure.

The metal carboxylates, including zinc octoates, may be prepared using any method known to be useful to those of ordinary skill in the art of making such compounds. For example, in one embodiment, a metal oxide is combined with ethyl hexanoic acid in the presence of acetic anhydride. Still, other methods may be employed wherein such methods result in a highly viscous additive. For the purposes of this disclosure, the term high viscosity when used in relation to a hydrogen sulfide scavenger, shall mean having a viscosity of greater than 60,000 centipoises at 60° F.

In addition to ethyl hexanoic acid, other carboxylic acids may be used with the method of the disclosure. Any carboxylic acid having from about 2 to about 18 carbons may be used to prepare metal carboxylates; subject to the proviso that the resulting composition is low enough in viscosity that it can be admixed with the viscosity improvers. Such acids include but are not limited to: acetic acid, propionic acid, hexanoic acid, nonanoic acid, decanoic acid, neo-decanoic acid, naphthoic acid, linoleic acid, naphthenic acid, tall oil acid, oleic acid, 2-methyl valeric acid, and the like. These other acids may be employed, but with the caveat that the resulting metal carboxylate has a higher viscosity prior to being mixed with the viscosity improver.

Also, most carboxylic acids are not available as pure reagents. For example ethyl hexanoic acid in some grades may have as much as 10% other acids present. Deliberately mixed carboxylic acids may also be used and are within the scope of this application. In one embodiment, the zinc carboxylate may be the product of reacting oxide or hydroxide zinc and both octanoic acid and neo-decanoic acid for example. The use of anhydrides as a source of acid is also within the scope of the application.

The hydrogen sulfide scavengers produced herein shall have a viscosity lower than that specified as high viscosity above. The amount of discussed improver to be employed though, will be determined by the end user as a function of a balance between the economic cost of the viscosity improver and the capability of the process in which the scavenger is going to be employed. For example, in a refinery, one unit may require a very low viscosity, such as one that is less than 1,000 centipoises at 60° F. In contrast, perhaps even in the unit immediately next to the first unit, the hydrogen sulfide scavenger can be employed at a viscosity of 10,000 centipoises at 60° F. In such an application, it may be desirable to reduce the amount of discussed improver employed. One of ordinary skill in the art of refining hydrocarbons will well know the capability of the units used for such refining. Generally though, the viscosity improver will be employed at a concentration of from about 1% to about 10%. In some embodiments, the viscosity improver will be employed at a concentration of from about 1 to about 30%. In still other embodiments, the viscosity improver will be employed at a concentration of from about 0.5 to about 60%.

The hydrogen sulfide scavengers claimed herein are useful in treating hydrocarbons. The hydrocarbons may be crude, partially refined, or fully refined and pending commercial consumption. When the hydrocarbons to be treated are crude hydrocarbons, in one embodiment they may be very "crude" and be, for example, crude oil or heavy fuels oils or even asphalt. In another embodiment, the crude hydrocarbon may only be "crude" in regard to a subsequent refining step. For example, in one embodiment, the method of the disclosure may be a refining step to produce light hydrocarbon fuels such as gasoline or aviation fuel. In refineries, the feed streams for such units have already undergone at least one step to remove components that are not desirable for producing such fuels. Thus, in this embodiment, the feed stream to this unit is a crude hydrocarbon even though it has had at least one refining process step already performed upon it.

Crude oil, when first produced is most often a multiphase fluid. It will have a hydrocarbon phase, aqueous phase, and may include both gases and solids. In some applications of the method of the disclosure, the hydrogen sulfide scavengers maybe employed in process water such as that produced during crude oil refining and even in wastewater that may be similarly contaminated.

In addition to being useful for mitigating the presence of hydrogen sulfide, the compositions of the application may be further used as odor control agents during the handling, transport, and storage of hydrocarbons. A further benefit of the use of the invention is a reduction of SOx emissions. A scavenged hydrogen sulfide, or at least the vast majority of it, comes from recovery systems in modern refineries. The ultimate disposal point for such materials is generally a thermal oxidizer. The resultant SOx emissions can be reduced if the hydrogen sulfide never reaches the thermal oxidizer.

EXAMPLES

The following examples are provided to illustrate the present invention. The examples are not intended to limit the scope of the present invention and they should not be so interpreted. Amounts are in weight parts or weight percentages unless otherwise indicated.

Examples 1-5 & Comparative Examples A & B

No control of just a Zinc carboxylate is shown as it is too viscous to test. Sample 1 is prepared by first admixing acetic anhydride, butoxy ethanol and 2-ethylhexanoic acid. To this mixture zinc oxide is then added. The resulting material is then heated and refluxed to compete the reaction and then distilled to remove water.

Samples 2-3 are prepared similarly except that the alcohol is added after the formation of the zinc carboxylate. Note: the viscosity improvers may be added before, during or after the reaction.

Each mixture is then tested for viscosity and the results are shown below in Table 1.

TABLE 1

| | Sample | | | | | | |
|---|---|---|---|---|---|---|---|
| Compositions WT % | 1 | 2 | 3 | 4 | 5 | A | B |
| ZnO | 20.75 | 19.27 | 21.18 | 21.18 | 21.19 | 21.35 | 17.82 |
| 2-ethylhexanoic acid | 73.52 | 68.26 | 74.94 | 74.94 | 74.97 | 75.48 | 63.12 |
| Acetic Anhydride | 0.5 | 0.5 | 0.50 | 0.5 | 0.5 | 0.5 | 0.5 |
| Aromatic 150 | | 8.97 | | | | 2.67 | 18.56 |
| 2-(2-butoxyethoxy) ethanol | 5.23 | | | | | | |
| 2-butoxyethanol | | 3.00 | | | | | |
| Isopropanol | | | 3.37 | | | | |
| Butanol | | | | 3.37 | | | |
| Methanol | | | | | 3.34 | | |
| Viscosity Cp @ 60° F. | | 6.6K | 16.7K | | | 468K | 68K |
| Viscosity Cp @ 68° F. | | | | 12.2K | | 397K | 52K |
| Viscosity Cp @ 90° F. | 18.9K | 1.8K | 3.8K | | | 173K | 40.6K |
| Viscosity Cp @ 100° F. | 14.8K | 1.2K | | | 1.8K | 142K | 32.4K |
| Viscosity Cp @ 120° F. | 10.0K | 600 | 1.2K | | | 95K | 21.1K |

Example 6

A crude oil stream was infused with about 2000 ppm hydrogen sulfide and then treated with the composition corresponding to Example 2 above. The test results are shown below in Table 2.

TABLE 2

| Test | Time after treatment | Dosage of Example 2 (ppm) | $H_2S$ ppm | % $H_2S$ Removed |
|---|---|---|---|---|
| 1 | 4 hrs | 0 | 2000 | N/A |
| 2 | 4 hrs | 700 | 350 | 82.5 |
| 3 | 4 hrs | 350 | 675 | 66 |
| 4 | 24 hrs | 700 | N/D | 100 |
| 5 | 24 hrs | 350 | 70 | 96 |

What is claimed is:

1. A method for treating fluids contaminated with hydrogen sulfide comprising introducing into the hydrogen sulfide contaminated fluid an additive for scavenging hydrogen sulfide from the hydrogen sulfide contaminated fluid, the additive comprising zinc octoate (1:2) and a viscosity improver comprising diethylene glycol mono-n-butyl ether.

2. The method of claim 1 wherein the zinc octoate is prepared using zinc powder or zinc oxide.

3. The method of claim 2 wherein the zinc octoate is prepared using ethyl hexanoic acid.

4. The method of claim 3 wherein the carboxylic acid used to prepare the zinc octoate is 2-ethyl hexanoic acid.

* * * * *